US011260678B2

(12) United States Patent
Knierim

(10) Patent No.: US 11,260,678 B2
(45) Date of Patent: Mar. 1, 2022

(54) PRINT SUBSTRATE OPTICAL MOTION SENSING AND DOT CLOCK GENERATION

(71) Applicant: XEROX CORPORATION, Norwalk, CT (US)

(72) Inventor: David L. Knierim, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/452,976

(22) Filed: Jun. 26, 2019

(65) Prior Publication Data

US 2020/0406616 A1 Dec. 31, 2020

(51) Int. Cl.

*B41J 11/00* (2006.01)
*B41J 2/045* (2006.01)
*B41J 2/125* (2006.01)

(52) U.S. Cl.

CPC ..... *B41J 11/008* (2013.01); *B41J 2/04573* (2013.01); *B41J 2/125* (2013.01)

(58) Field of Classification Search

CPC ..... B41J 2/04573
See application file for complete search history.

(56) References Cited

U.S. PATENT DOCUMENTS 4,631,400 A 12/1986 Tanner et al.
4,794,384 A 12/1988 Jackson
5,089,712 A 2/1992 Holland
6,246,050 B1 6/2001 Tullis et al.
2003/0058218 A1* 3/2003 Crane ..... G06F 3/0317 345/158
2006/0132517 A1* 6/2006 Vinas ..... B41J 2/04586 347/9
2009/0213166 A1* 8/2009 Burke ..... B41J 2/1753 347/19
2010/0199475 A1* 8/2010 Tremblay ..... B65H 23/1888 26/71
2014/0043621 A1* 2/2014 Ahner ..... G01N 21/8806 356/612
2015/0010240 A1* 1/2015 Sumitomo ..... G06K 9/4642 382/205
2016/0325566 A1* 11/2016 Kurane ..... B41J 13/0009
2017/0106675 A1* 4/2017 Murotani ..... B41J 11/06
2017/0266965 A1* 9/2017 Gohda ..... B41J 2/2135
2019/0057288 A1* 2/2019 Tokushima ..... B25J 9/042

* cited by examiner

*Primary Examiner* — Shelby L Fidler
(74) *Attorney, Agent, or Firm* — Miller Nash LLP

(57) ABSTRACT

A system to direct print onto print substrates has a print head, at least one optical image sensor arranged adjacent a print substrate, wherein the print substrate will move in a process direction past the print head, at least one telecentric lens arranged between the print substrate and the at least one optical image sensor, and control circuitry electrically connected to the optical at least one image sensor and the print head, the control circuitry to generate dot clocks to cause the print head to print onto the substrate based upon data from the at least one optical image sensor identifying a position of the print substrate.

7 Claims, 6 Drawing Sheets

PRINT SUBSTRATE OPTICAL MOTION SENSING AND DOT CLOCK GENERATION

TECHNICAL FIELD

This disclosure relates to printing on moving substrates, more particularly to generation of a dot clock based upon motion of the substrate.

BACKGROUND

Direct printing of substrates involves a print head depositing ink onto a substrate at the correct position. This means that the printer needs to know the position and velocity of the substrate in order to trigger the print head to deposit the ink at the correct time and in the correct place to form an image.

When the printer accurately constrains the substrate, as in an enclosed sheet feed system familiar as desktop and office printers, the printer typically tracks substrate motion by measuring motion of a roller or belt that is engaged against the substrate. This may be a belt or roller that moves the substrate, or a separate roller that is moved by the substrate. Substrate motion may also be inferred by counting steps of a stepper motor used to drive a roller or belt that moves the substrate. Roller motion measurement is typically by an optical encoder consisting of an encoder and encoder wheel. Just as an example, the printer may have a rotary encoder wheel and encoder on a roller that feeds the substrate into the printer. The encoder wheel will contain a pattern of marks on its surface. The encoder portion typically includes a light source and photosensors to detect the presence or absence of the marks at a rate that allows the system to determine the speed of the substrate and allows control of the printing process. The motion of the substrate may be referred to as the print or process direction.

Some printers have a stationary set of one or more print heads covering the entire width of the printed image in the cross-process (lateral) direction. Desktop printers often use smaller print head(s) that shuttle laterally across the substrate. To track lateral motion of the print head, a linear encoder may be used. A linear encoder works similarly to the rotatory encoder but the encoder strip is typically a linear piece of polyester or other material that contains the marks. The light source and photosensors may be mounted to the print head and move relative to the strip. This allows the controller to know how fast the print head is traveling and allows the print head to print the ink at the correct time.

Using two encoders and two encoder patterns can drive up the cost of the printer. One embodiment, as shown in U.S. Pat. No. 6,246,050, uses images of a fixed feature of the printer itself instead of the patterned strip to allow determination of the position of the print head and its movement. However, this type of approach is not precise enough for practical printing use.

For larger systems, in which the substrates are not contained within a housing or casing while being printed, position and movement detection becomes even more difficult. One approach relies upon the speed of the conveyor belt upon which the substrates move past the print head for printing, as in printing on cardboard boxes. In another approach, a spring-loaded encoder roller rolls against the boxes as they pass in front of the print head.

SUMMARY

According to aspects illustrated here, there is provided a system to direct print onto print substrates having a print head, at least one optical image sensor arranged adjacent a print substrate, wherein the print substrate will move in a process direction past the print head, a telecentric lens arranged between the print substrate and the image sensor, and control circuitry electrically connected to the optical image sensor and the print head, the control circuitry to generate dot clocks to cause the print head to print onto the substrate based upon data from the image sensor identifying a position of the print substrate.

According to aspects illustrated here, there is provided a method of printing on a moving substrate that includes acquiring image data of a print substrate from an image sensor, using the image data to determine a velocity of the print substrate, generating a dot clock based upon the velocity of the print substrate, and transmitting the dot clock to a print head to cause the print head to dispense ink onto the print substrate.

DETAILED DESCRIPTION OF THE EMBODIMENTS

The embodiments here consists of a combination of several components. The components may include a linear optical image sensor, a lens to project an image of a print substrate onto the image sensor, illumination for a portion of the substrate viewed by the image sensor, and electronics to generate dot clocks in response to the image sensor data. The combination of image sensor, lens and illumination may be referred to as the print substrate tracking, or just tracking, system. The tracking system will typically be mounted adjacent to a print head.

The "process direction" is the direction in which the substrate moves under or in front of the print head. The "cross process direction" is a direction that is substantially perpendicular to the process direction. The term 'print substrate' comprises any movable surface upon which ink can be deposited.

The term "print head" typically comprises a drop generator, such as a jet stack. A jet stack generally consists of a stack of plates having manifolds to route ink to an array of nozzles that selectively dispense ink depending upon the image data when they receive a signal. The signals are generated by a dot clock generator. As used here, the term 'dot clock' is the signal sent to the jet stack or other drop generator to cause the selected nozzles in the jet stack or drop generator to dispense dots of ink.

One should note that the print head, print substrate tracking system, and print substrate are shown in various orientations here. No limitation to any particular orientation is intended nor should any be implied.

Figure 1:
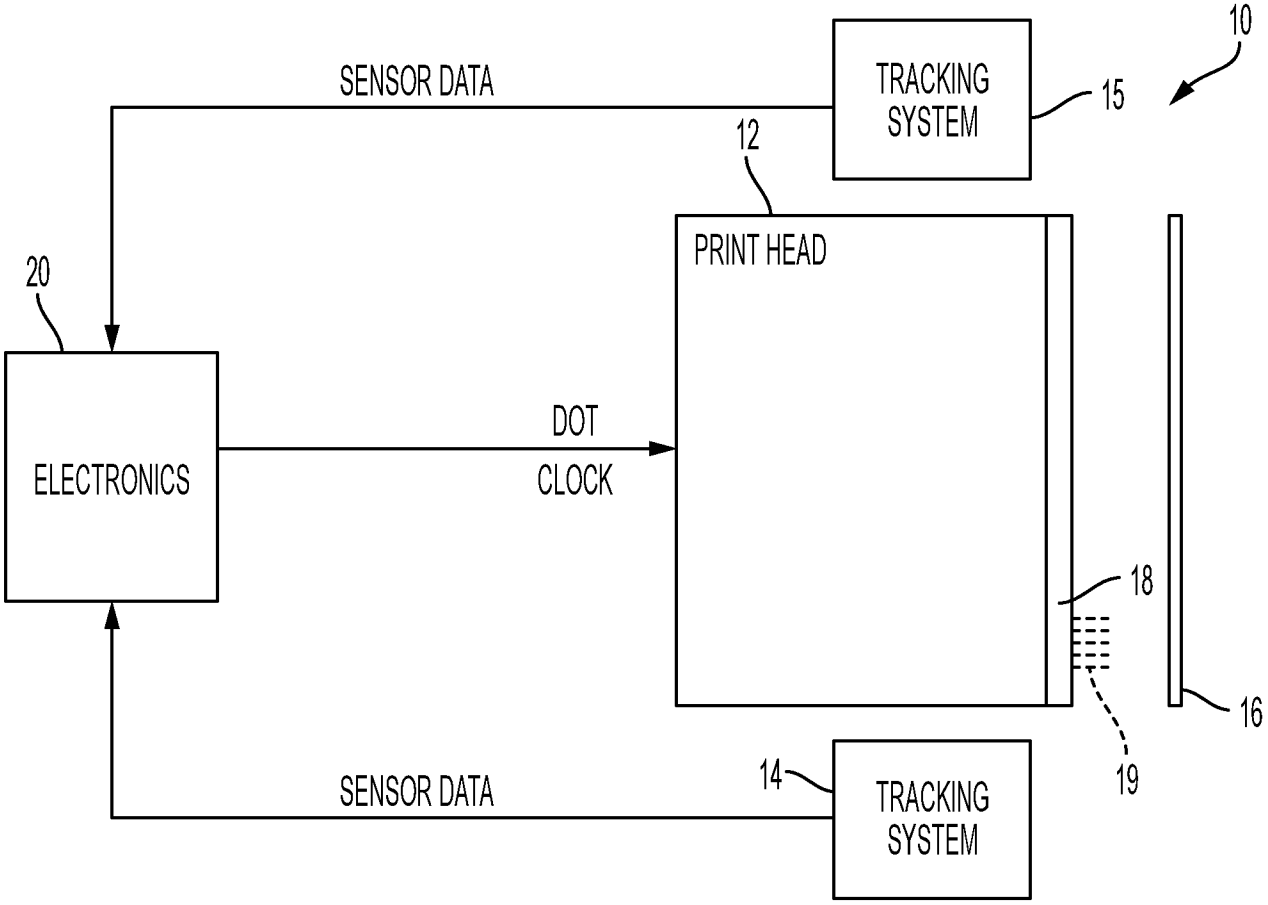
FIG. 1 shows an embodiment of a print head having a print substrate tracking system.

FIG. 1 shows an embodiment of a print head 12 with a print substrate tracking system 14 as an integrated system 10. The print substrate tracking system is typically mounted adjacent to the print head. The print head includes a jet stack or other drop generator 18, which may include an array of jets or nozzles 19. The electronics 20 for the tracking system, which may be integrated into the control electronics of the printing system, or may be separate control electronics used only for the tracking systems. The electronics receive image data from the sensors and use that data to generate dot clocks that will then provide the signal to cause the drop generator to dispense ink on the substrate 16. The system may have one tracking system such as 14 or two tracking systems such as 14 and 15, on opposite sides of the print head. In the case of the use of one image sensor, it may be located in one of several places relative to the print head. Alternatively, there may just be two imaging systems with only one set of electronics.

Figure 2:
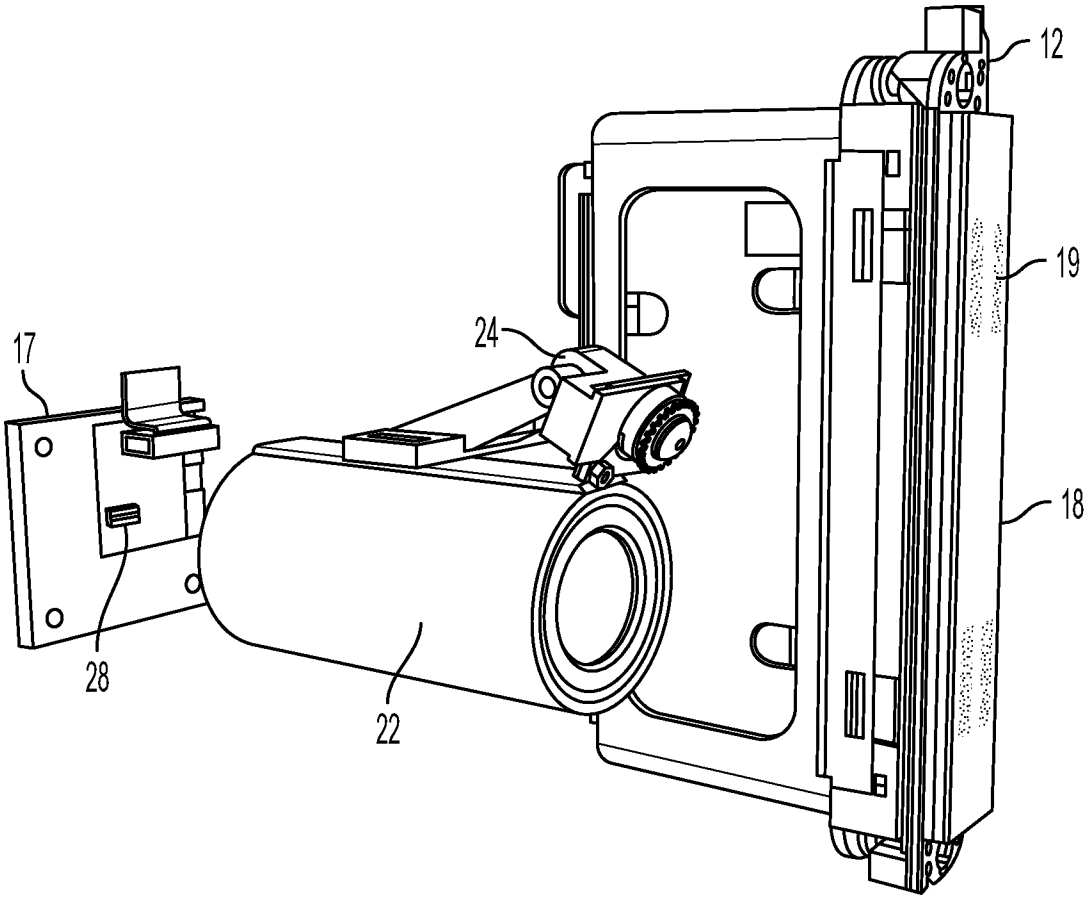
FIG. 2 shows an embodiment of a print substrate tracking system located adjacent the print head.
Figure 3:
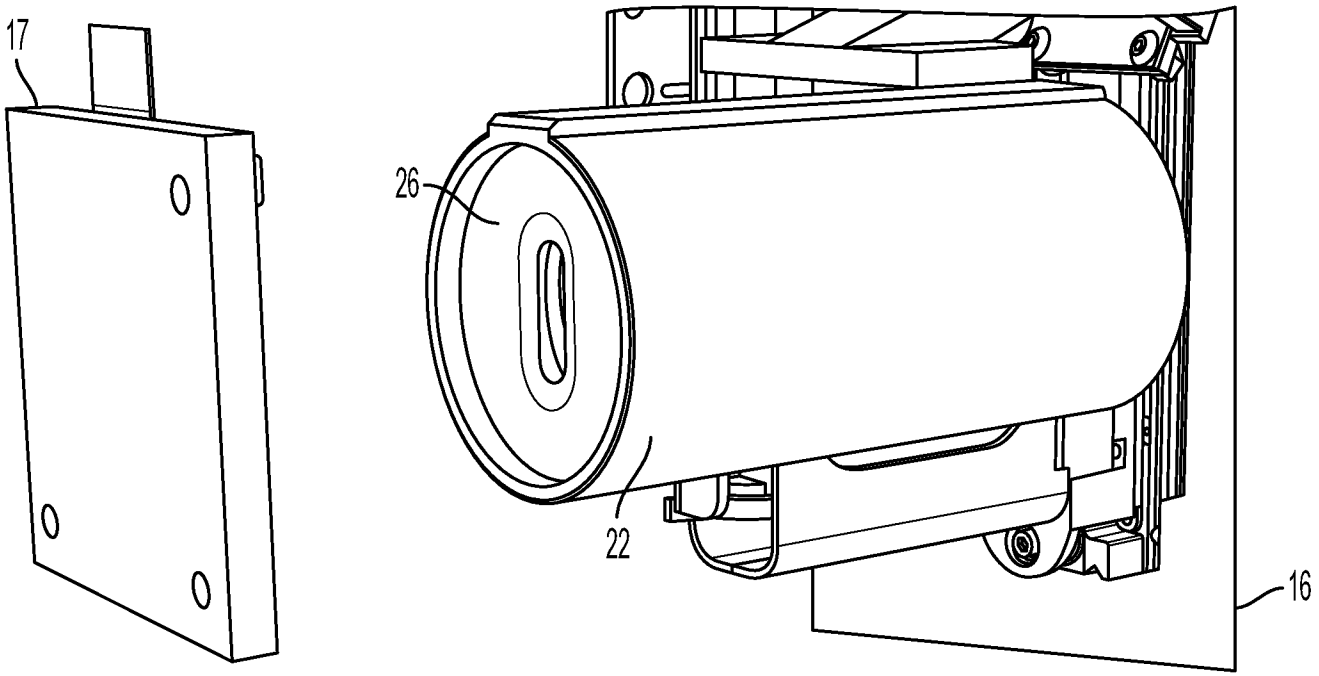
FIG. 3 shows an aperture of a telecentric lens used to image the print substrate onto an image sensor.

FIGS. 2 and 3 show more detailed views of the system 10. FIG. 2 shows the print head 12 without the substrate, to give a better view of the jet stack 18 and is array of nozzles 19. FIG. 3 shows a closer view of the telecentric lens 22 and its aperture 26 between the image sensor mounting 17 and the substrate 16.

Generally, the tracking system 14 of FIG. 1 will include four components: a linear optical image sensor, a telecentric lens, illumination, and electronics to generate dot clocks in response to image sensor data. In this embodiment the tracking system comprises a telecentric lens 22, at least one illumination source 24, and an image sensor 28 and its mounting 17. The telecentric lens 22 may include an aperture 26, either internal or external to other lens elements, shown in FIG. 3. The lens 22, with or without the aperture 26, provides an image of the print substrate 16 to the image sensor.

Figure 4:
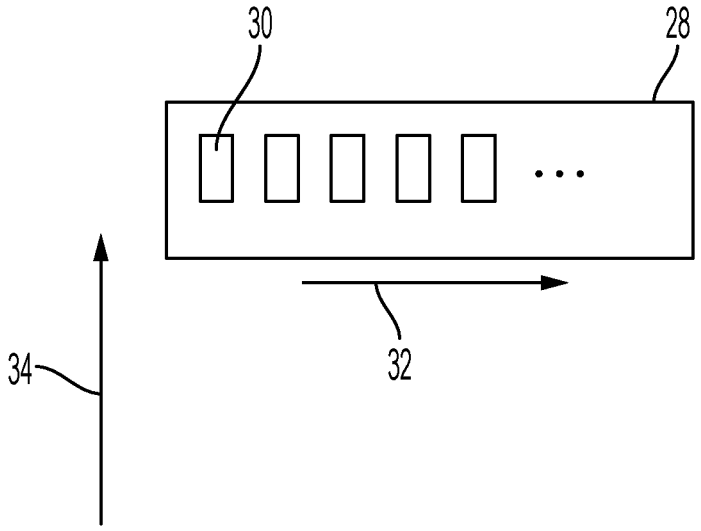
FIG. 4 shows an embodiment of the image sensor having elongated pixels.

The linear image sensor 28 may have high-aspect ratio pixels. As shown in FIG. 4, the pixels such as 30 are longer in the cross-process direction and shorter in the process direction. The process direction is shown as arrow 32 and the cross process direction is shown as arrow 34. The elongated pixels collect more light, improving the signal-to-noise ratio, and reduce sensitivity to substrate motion that is not exactly parallel to the process direction axis of the image sensor. In one embodiment, the length to width ratio is approximately 50:1.

The image sensor also needs a reasonably high frame (line) rate. It needs not be higher than the dot clock frequency. In one embodiment, for example, the image sensor uses a 6 kHz frame rate to generate 64 kHz dot clocks. 6 kHz will typically be fast enough to track velocity changes of the print substrate. The measured velocity feeds a rate-generator to make the 64 kHz dot clock. The dot clock will vary from 64 kHz as the velocity of the print substrate varies. This assists with maintaining printed dot positions.

The lens may comprise a telecentric lens, meaning its entrance pupil is at infinity, in its object space. In this case the object space is the print substrate side of the lens, making optical magnification independent of substrate-to-lens distance. This improved tolerance to substrate warpage or placement error. Variation in substrate-to-lens distance corresponds to variation in substrate-to-print-head distance, so should be reasonably well controlled to maintain print quality. The telecentricity precision of the lens need not be too high, keeping lens cost low. As long as the image sensor to lens distance is precise, there is no need for the lens to be doubly telecentric, although that may be an option.

Variations in lens-to-substrate distance will cause focus errors, known as blur, even with a telecentric lens. A slower lens, meaning a smaller aperture, will increase the depth-of-field, but gather less light. For the embodiments here, focus is important along the motion axis or the process direction, but much less so along the perpendicular axis where the image sensor pixels are elongated. To optimize both depth-of-field and light gathering, a slit aperture may work better, with the slit width along the motion axis, or process direction, shorter than the slit height perpendicular to the motion direction, or cross-process direction. As shown in FIG. 3, the aperture is separated but will generally be part of the lens assembly.

Figure 5:
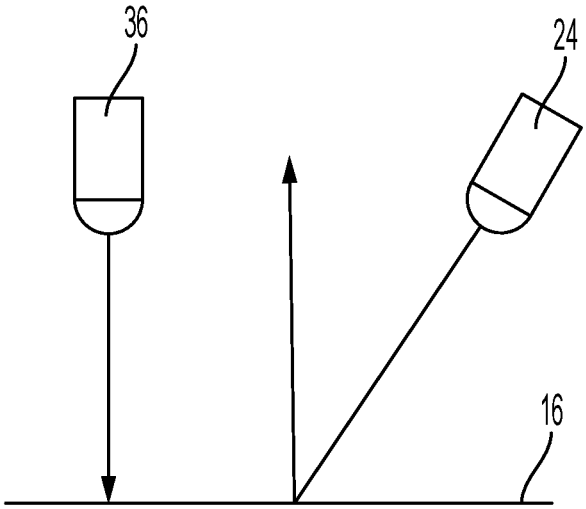
FIG. 5 shows an embodiment of two illumination sources as part of a print substrate tracking system.

The tracking system may include at least one illumination source, as shown in FIG. 5, and may be arranged at a glancing angle as shown at illumination source 24. Glancing illumination converts physical texture on the print substrate 16 into optical texture. For precision encoding, glancing-angle illumination must be with parallel light rays, or at least where the distribution of incident ray angles is uniform across the imaged area. Otherwise, the angles of texture shadows change with substrate position, which causes the optical texture to move faster or slower than the print substrate depending on the direction of angle change. Illumination from a steeper angle, closer to perpendicular to the substrate surface as in illumination source 36, drastically reduces the need for parallel light rays, but also reduces the image contrast for typical print substrates. Shallow and steep illumination angles both function acceptably in the prototype. Intensity uniformity is less important than angle uniformity. Intensity variations can be corrected with pixel value scaling in the electronics, based on an initial calibration.

Illumination may be strobed at the image sensor frame rate. The substrate may move pixels from one frame to the next, up to some number. In one embodiment, up to 51 pixels moved from one frame to the next. This is excessive motion blur for accurate velocity measurement. Some degree of motion blur has advantages, such as removing spatial frequencies above the Nyquist spatial frequency of the image sensor. The illumination strobe pulse width may be adjusted based on the expected or measured velocity to result in the optimum amount of low-pass filtering from motion blur. A simple on/off pulse of illumination will result in a rectangular impulse response filter, often call a "box-car" filter. Controlling illumination brightness in a Gaussian intensity-vs-time profile will result in Gaussian image blur. This approach works efficiently, but has a higher complexity of implementation. A Gaussian filter can be approximated using simple on/off control and duty-cycle modulation.

Figure 6:
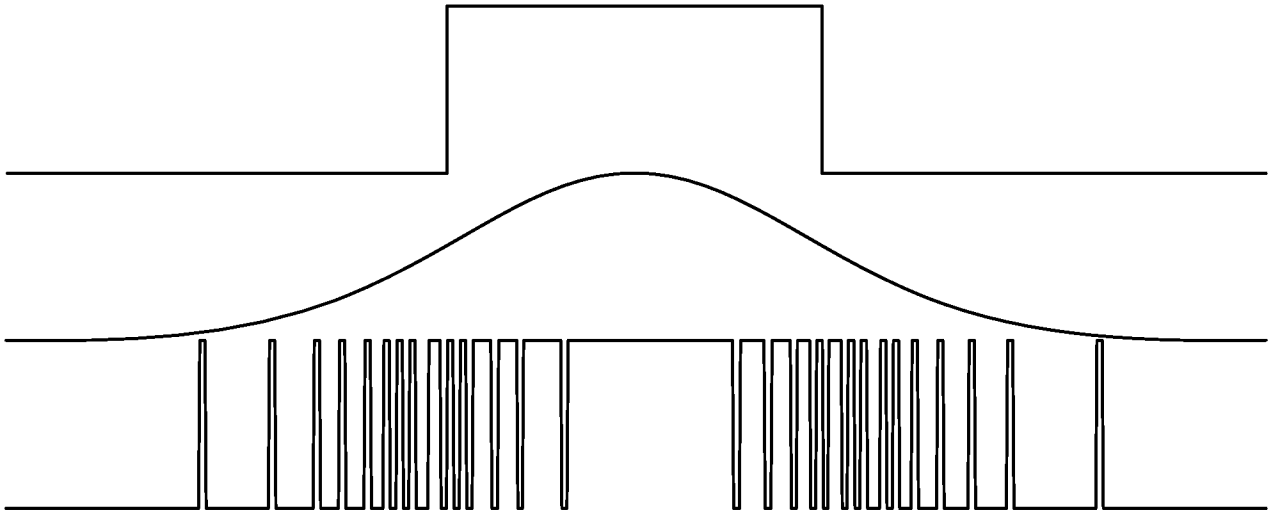
FIG. 6 shows options for illumination source intensity vs. time profiles.

Intensity vs. time plots of these three illumination options are shown in FIG. 6. The box-car illumination strobe option, the top trace, may be sufficient for many applications. Gaussian, the middle trace, or simulated-Gaussian, the third trace, will further reduce Nyquist aliasing for the highest precision.

The electronics 20 from FIG. 1 will process the image data from the sensor, generating dot clocks in response to the print substrate motion. In one embodiment, the electronics comprise an analog-to-digital (ADC) converter and a field-programmable gate array (FPGA), along with conventional support circuitry around them, such as a clock oscillator, DC supply voltages, bypass capacitors, etc.

Linear image sensors typically output pixel values sequentially after the expose time window is complete, often simultaneously with the next frame's exposure window. To minimize latency, the electronics may process each new pixel value as it comes in, providing updated position and velocity information after the last pixel of an image frame is read from the sensor. Reduced latency provides faster response to changes in print substrate velocity, minimizing printed drop placement errors.

Figure 7:
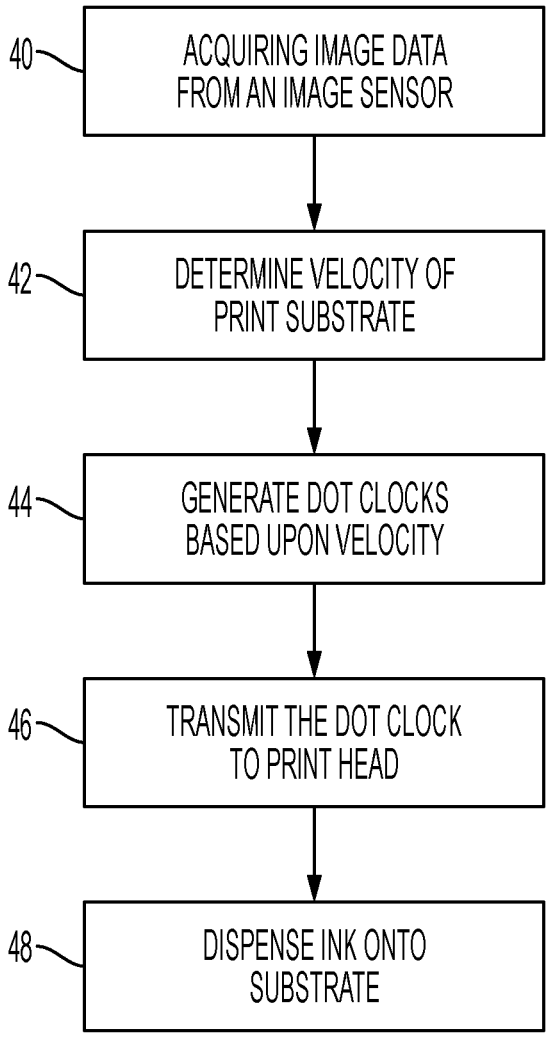
FIG. 7 shows a flowchart of an embodiment of a method to track a print substrate.

FIG. 7 shows a flow chart of an embodiment of a general method of tracking a print substrate. Initially, the image sensor provides image data to the control electronics at 40. The control electronics then process the image data to determine the velocity of the print substrate at 42. Using the velocity, the control electronics generate the dot clocks at 44. The dot clocks are then transmitted from the electronics to the drop generator at 46. The drop generators then dispense ink onto the substrate at 48.

This process may encompass several sub-processes. For example, the electronics may apply compensation such as subtracting per-pixel black offset, which compensates for image sensor black-level pattern noise. The electronics may also apply per-pixel scale to compensate for image sensor sensitivity and for illumination spatial variations.

Additionally, the image data may undergo filtering. For example, the process may apply a high-pass filter to the image or pixel data. In one embodiment, the filter is applied by dividing each pixel by a Gaussian-weighted average of its neighboring pixels. In one embodiment, 64 neighboring pixels are used, 32 on each side. Dividing by the weighted average rather than subtracting it reduces sensitivity to local variations in illumination intensity as might be caused by warp of the print substrate. It also cancels global illumination variation, such as from LED power supply noise.

The image data from the sensor may have its resolution increased by interpolating the image data. In one embodiment the data is interpolated by 8 times using a Gaussian low-pass interpolation filter. The process then stores the integer-pixel-position values for correlating with the next frame. In one embodiment, these values are after the weighted average low-pass filter, even though they are at the non-interpolated pixel locations. This keeps the frequency response identical between the interpolated and integer pixel values.

The process then calculates some predetermined number, such as 32, "coarse" correlations between the incoming pixel values and the ones stored from the previous frame. In one embodiment, the correlation is a sum of differences squared rather than a true correlation. These "coarse" correlations are done at position offsets, for example of −10 through +52 pixels, between the incoming line image and the stored previous line image. Negative offsets need not be included, but are convenient for testing.

The process then finds the maximum correlation, in one embodiment meaning the minimum sum-of-differences-squared, of the coarse correlations. This may be achieved by fitting a parabola to this minimum and its neighboring two correlations, one on each side. The process can determine a coarse velocity, meaning the position change from the previous image frame to this frame, by the position of the parabola minimum.

The process can then calculate a predetermined number of "fine" correlations between the incoming interpolated pixel values and the pixel values stored from the previous frame. Again, the correlation may be a sum of differences squared rather than a true correlation. These "fine" correlations may be done at sub-pixel offsets, such as ⅛th pixel position offsets, centered near the coarse correlation position determined above for the previous frame. The process does not use the current frame's coarse correlation because it is not known until all of this frame's pixel data is read. Using the previous frame's coarse correlation position allows fine correlation to process pixel data as it comes in, reducing latency.

The process then repeats finding the maximum correlation using the parabola analysis above, but now applied to the fine correlations. This results in a determination of a fine velocity, position change from the previous image frame to this frame, by the position of the parabola minimum. The process may add in the coarse offset from the previous frame used to locate the pixel-offset range for this set of fine correlations. Optionally, the process may apply a low-pass filter to the fine velocity values to smooth any jitter in velocity values, but such filtering does increase latency.

Using the fine velocity, or the filtered fine velocity, in a rate generator produces dot clocks to trigger print head drop ejection. For example, add the fine velocity value to an accumulator at a fixed rate, for example 72 MHz. Each time the accumulator overflows, the process outputs a dot clock and subtracts a dot-spacing constant from the accumulator. The dot-spacing constant is proportional to the desired spacing between printed dots. For example, if the image sensor frame time is N 72 MHz clocks, then a dot-spacing constant value of N would generate dot clocks at the same spacing as image sensor pixel spacing, assuming a 1:1 lens magnification. A dot-spacing constant of 2N would generate dot clocks at twice the image sensor pixel spacing.

One should note that there will be fractional-pixel bits to the fine velocity. The accumulator and constant need to have the same number of fraction bits. Dot clock spacing is not restricted to integer ratios of image sensor pixel spacing.

The number of coarse and fine correlations, 32 each in the embodiments above, could be smaller. The process may also skip the coarse correlations, using the previous frame's fine correlation location to center the current frame's fine correlation range. This embodiment may require a way to initialize the fine correlation range, such as a sweep-search after each new image substrate comes into view.

Besides generating dot clocks, the image sensor can be used to detect the presence of a print substrate. When a substrate is not present, illumination will not align with whatever surface(s) may lie past the normal print substrate location, so little light will reach the image sensor. This dark condition indicates the absence of a print substrate. In one embodiment, this feature is being used to sense the beginning of each print substrate to trigger the start of a new image.

Many variations and modifications exist and contained within the scope of the claims. For example, it is desirable to sense print substrate motion at a location close to the print head. This minimizes the unprinted margin at the end of each substrate. A small mirror could be added to the optical path close to the print substrate, allowing the remainder of the mechanism to pivot away from the print head.

The optical sensor could be positioned above or below the print head(s) if there is more unprinted margin there. This is described for the case of a vertical print substrate orientation with horizontal print motion, or horizontal process direction. Other orientations are equally possible, such as a horizontal print substrate and down-shooting print head(s), as noted above.

For use with thin print substrates, such as cardboard before being folded into a box, this sensor could view the print substrate from the opposite side relative to the print head. Sensing could be located immediately behind the print head(s), as long as no significant image bleed-through occurs, at least not until after the substrate moves past the sensor.

Another option to reduce non-printed margins is to use two sensors, one on each side of the print head. The two sensors could each be part of their own tracking system or share the electronics and/or other components between them. Velocity inputs to the dot clock generator would switch from one sensor to the other as the substrate moves past the print head(s). The switching could be based on which sensor detects a higher average image intensity, as an indication of which sensor has a complete image of the print substrate.

A SELFOC® lens array, comprising an array of microlenses, might be workable as a small low-cost alternative to a telecentric lens. It would likely have motion artifacts due to the lens element pitch, but such artifacts may be tolerable for some applications.

In one embodiment the telecentric lens consisted of a pair of 35 mm slide projector lenses joined front-to-front, combined with an aperture located to make it object-side telecentric. This lens assembly may be much larger than a final system needs to use. The large lens could be advantageous in a few applications, with its 80 mm standoff from lens to print substrate, but any size lens could be employed and be within the scope of the claims.

In this manner, a high efficiency, low latency printing system with print substrate tracking can be realized. The tracking system may have its electronics physically integrated with the image sensor and lens, or may share electronics with other parts of the printing system.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system to direct print onto print substrates, comprising:

a print head; and at least one tracking system, each tracking system comprising:

a linear optical image sensor arranged adjacent a print substrate, wherein the print substrate will move in a process direction past the print head;

at least one telecentric lens arranged between the print substrate and the linear optical image sensor; and control circuitry electrically connected to the linear optical image sensor and the print head, the control circuitry to generate dot clocks to cause the print head to print onto the print substrate based upon data from the linear optical image sensor identifying a position of the print substrate, the control circuitry to determine the position of the print substrate based upon a velocity of the print substrate found by correlating pixel values from a previous frame of data previous to a current frame of data from the linear optical image sensor to pixel values of the current frame of data from the linear optical image sensor in a first coarse correlation and then a fine correlation, wherein the fine correlation for the current frame of data is centered near a coarse correlation determined for the previous frame of data.

2. The system as claimed in claim 1, further comprising at least one illumination source positioned to provide light to a region of the print substrate viewed by the linear optical image sensor.

3. The system as claimed in claim 2, wherein at least one of the at least one illumination sources is positioned at a glancing angle to the print substrate.

4. The system as claimed in claim 2, wherein the at least one illumination source consists of at least two illumination sources, one positioned at a glancing angle to the print substrate and the other positioned closer to perpendicular to the print substrate.

5. The system as claimed in claim 2, wherein the at least one illumination source is strobed.

6. The system as claimed in claim 1, wherein the at least one telecentric lens includes an aperture that is shorter in the process direction than in a cross-process direction.

7. The system as claimed in claim 1, wherein the linear optical image sensor has rectangular pixels, shorter in the process direction than in a cross-process direction.

* * * * *